US007588644B1

(12) United States Patent
Olivier

(10) Patent No.: US 7,588,644 B1
(45) Date of Patent: Sep. 15, 2009

(54) METHOD AND APPARATUS FOR CLEANING PIPELINE PIGS

(75) Inventor: Pierre L. Olivier, Houma, LA (US)

(73) Assignee: Integris Rentals, L.L.C., Houma, LA (US)

( * ) Notice: Subject to any disclaimer, the term of this patent is extended or adjusted under 35 U.S.C. 154(b) by 157 days.

(21) Appl. No.: 11/847,902

(22) Filed: Aug. 30, 2007

Related U.S. Application Data

(60) Provisional application No. 60/823,999, filed on Aug. 30, 2006.

(51) Int. Cl.
*B08B 3/04* (2006.01)

(52) U.S. Cl. ..... 134/10; 134/26; 134/30; 134/32; 134/34; 134/35; 134/36; 134/39; 134/40; 134/42; 134/94.1; 134/102.2; 134/104.4; 134/184

(58) Field of Classification Search ..... 134/10, 134/26, 30, 32, 34, 35, 36, 39, 40, 42, 94.1, 134/102.2, 104.4, 184
See application file for complete search history.

(56) References Cited

U.S. PATENT DOCUMENTS

| | | | |
|---|---|---|---|
| 4,529,345 | A | 7/1985 | Van Gompel |
| 4,566,819 | A | 1/1986 | Johnston |
| 4,799,840 | A | 1/1989 | Van Gompel et al. |
| 4,860,913 | A | 8/1989 | Bertolini |
| 4,907,314 | A | 3/1990 | Kershaw |
| 5,018,629 | A | 5/1991 | Lamar |
| 5,150,493 | A | 9/1992 | Sivacoe |
| 5,196,161 | A | 3/1993 | Lewis |
| 5,265,302 | A | 11/1993 | Sivacoe |
| 5,292,012 | A | 3/1994 | Davis et al. |
| 5,359,955 | A | 11/1994 | Grebenyuk |
| 5,385,049 | A | 1/1995 | Hunt et al. |
| D363,587 | S | 10/1995 | Glinski |
| 5,704,476 | A | 1/1998 | Abbott |
| 5,857,416 | A | 1/1999 | Donnell, Jr. et al. |
| 5,903,945 | A | 5/1999 | Lundie |
| 5,924,158 | A | 7/1999 | Watts |
| 6,299,008 | B1 | 10/2001 | Payne |
| 6,311,628 | B1 | 11/2001 | Smith et al. |

(Continued)

FOREIGN PATENT DOCUMENTS

| | | |
|---|---|---|
| WO | WO 2007/024951 | 3/2007 |

*Primary Examiner*—Sharidan Carrillo
(74) *Attorney, Agent, or Firm*—Garvey, Smith, Nehrbass & North, L.L.C.; Seth M. Nehrbass; Charles C. Garvey, Jr.

(57) ABSTRACT

A method of cleaning pipeline pigs of a material that is to be recycled includes providing a vessel having an interior. A manifold is placed within the vessel interior, the manifold having a plurality of openings. The vessel is filled with a solvent that is capable of dissolving the material to be recycled. The pipeline pig is placed in the vessel and above the manifold. A volume of gas is bubbled into the vessel via the manifold openings. These steps are repeated with multiple pigs in sequence so that the material to be recycled is concentrated over time within the vessel. Thereafter, the material that has accumulated within the vessel is recycled. The solvent is preferably a terpene blend with an ethoxylated alcohol. The material to be recycled is preferably paraffin and/or asphaltene.

12 Claims, 4 Drawing Sheets

U.S. PATENT DOCUMENTS

| | | | | |
|---|---|---|---|---|
| 6,357,365 | B1 | 3/2002 | Higgins et al. | |
| 6,475,294 | B2 | 11/2002 | McCanna et al. | |
| 6,500,271 | B1 | 12/2002 | Moore et al. | |
| 6,533,122 | B1 | 3/2003 | Plunkett | |
| 6,679,129 | B2 | 1/2004 | Savard | |
| 6,792,641 | B1 | 9/2004 | Laker | |
| 2001/0038009 | A1 | 11/2001 | Payne | |
| 2004/0194809 | A1* | 10/2004 | Crawford et al. | 134/22.12 |
| 2005/0266124 | A1 | 12/2005 | Stoker | |
| 2006/0011341 | A1 | 1/2006 | Campbell | |
| 2007/0045205 | A1 | 3/2007 | Olivier | |

* cited by examiner

METHOD AND APPARATUS FOR CLEANING PIPELINE PIGS

CROSS-REFERENCE TO RELATED APPLICATIONS

Priority of U.S. Provisional Patent Application Ser. No. 60/823,999, filed Aug. 30, 2006, incorporated herein by reference, is hereby claimed.

My U.S. patent application Ser. No. 11/746,575, filed May 9, 2007, is hereby incorporated herein by reference.

My International Patent Application Serial No. PCT/US2006/032923, filed Aug. 23, 2006, is hereby incorporated herein by reference.

My U.S. patent application Ser. No. 11/466,272, filed Aug. 22, 2006, is hereby incorporated herein by reference.

My U.S. Provisional Patent Application Ser. No. 60/806,415, filed Jun. 30, 2006, is hereby incorporated herein by reference.

My U.S. Provisional Patent Application Ser. No. 60/762,346, filed Jan. 26, 2006, is hereby incorporated herein by reference.

My U.S. Provisional Patent Application Ser. No. 60/710,562, filed Aug. 23, 2005, is hereby incorporated herein by reference.

This is not a continuation or continuation-in-part of any patent application.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus for cleaning residue from the surface of a pipeline pig device. More particularly, the present invention relates to a method and apparatus for cleaning residue from the surface of a pipeline pig device wherein a solvent contained in a vat or vessel dissolves the residue from the surface of the pipeline pig and wherein after multiple of the pipeline pigs have been cycled through the solvent, the solvent can be recycled the combination of solvent and residue being a saleable recycled fuel product.

2. General Background of the Invention

Pipeline pig devices are used for cleaning pipelines of residue such as scale, rust, debris, deposits (e.g. paraffin) or the like. After use, a pipeline pig can be coated with paraffin, for example. This product is desirably removed from the pipeline pig before it is used again.

BRIEF SUMMARY OF THE INVENTION

The present invention provides an improved method of and apparatus for removing paraffin or like chemical residue from the surface of a pipeline pig.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 5:
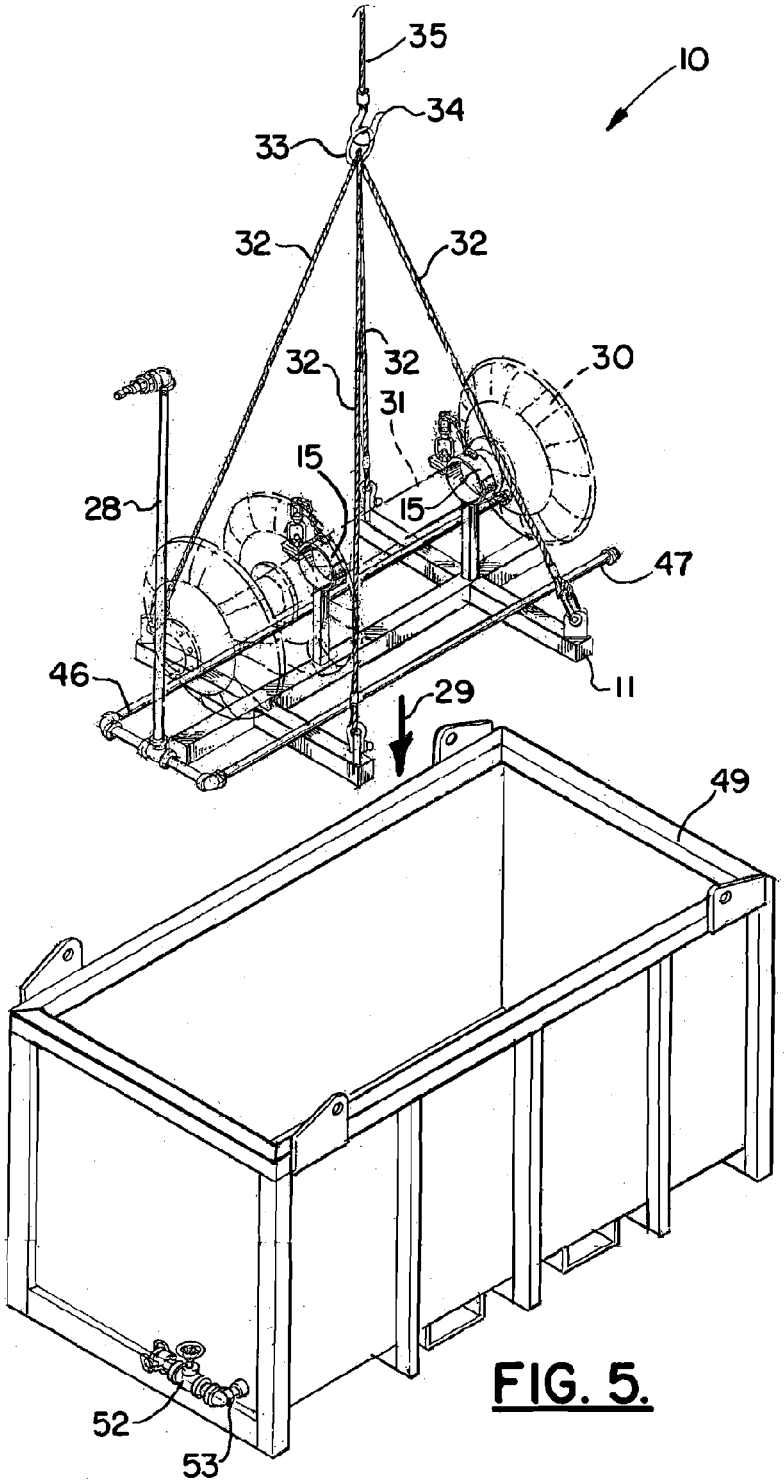
FIG. 5 is a perspective view of the preferred embodiment of the apparatus of the present invention.
Figure 6:
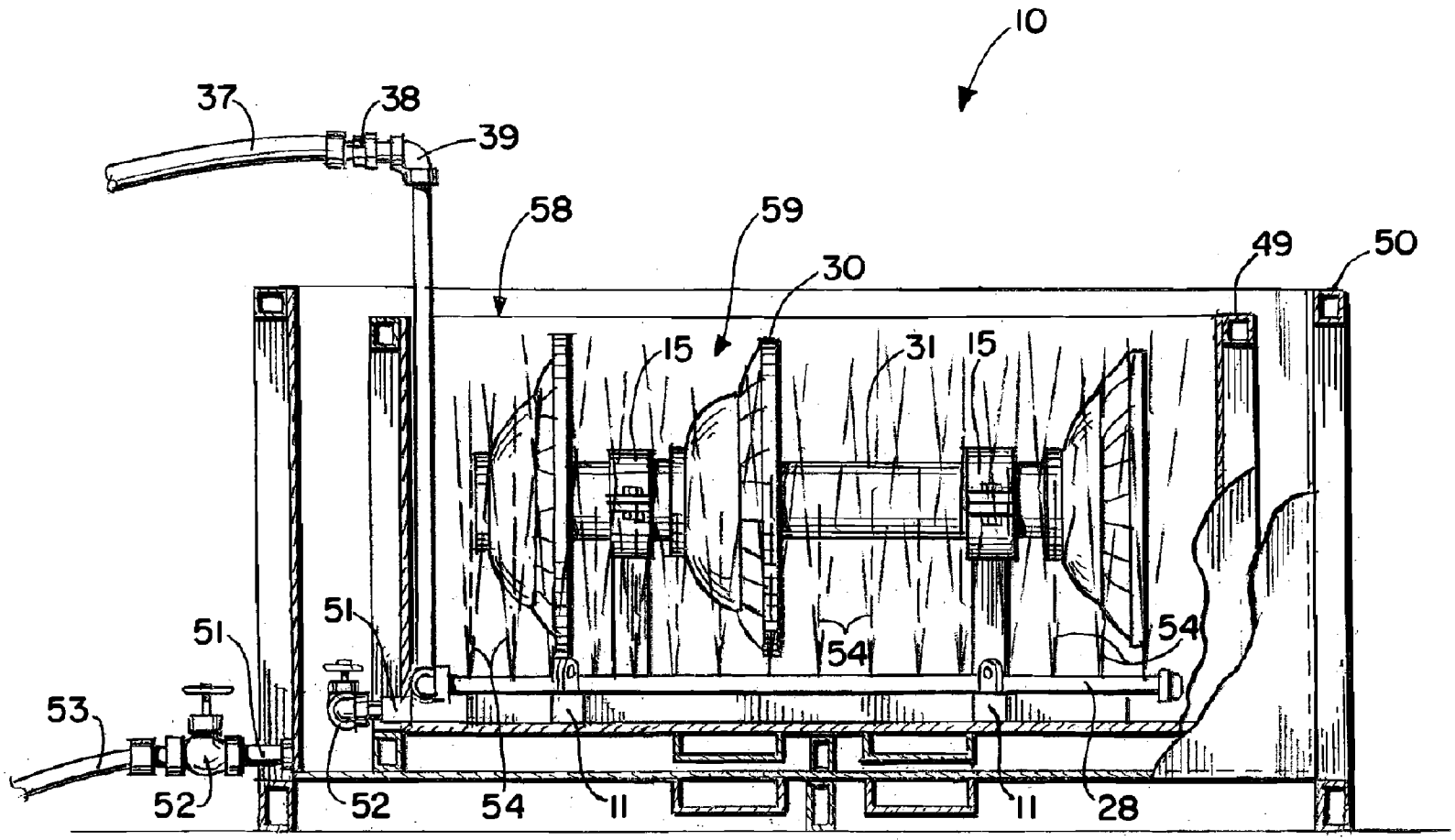
FIG. 6 is a sectional elevation view of the preferred embodiment of the apparatus of the present invention.

FIGS. 5 and 6 show generally the preferred embodiment of the apparatus of the present invention designated generally by the numeral 10 in FIGS. 5 and 6.

Pipeline pig cleaning apparatus 10 employs a frame 11 (which can be, for example, about 3-18 feet long, about 3-6 feet wide, and about 3-5 feet high) that can be comprised of one or more longitudinal beams 12 which can each be about 3-6 inches high by about 3-6 inches wide by 1-18 feet long) and one or more transverse beams 13 (which can each be about 3-6 inches high by about 3-6 inches wide by 1-6 feet long). The frame 11 can be, for example, of welded metal construction, such as welded steel or welded aluminum.

Figure 3:
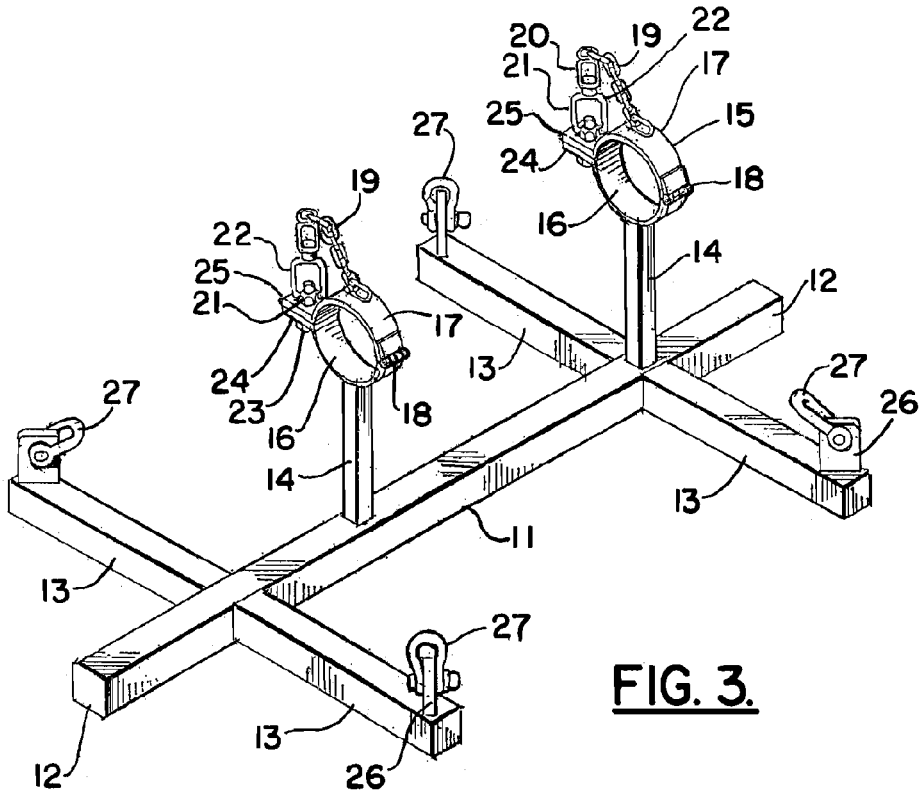
FIG. 3 is a partial perspective view of the preferred embodiment of the apparatus of the present invention.
Figure 4:
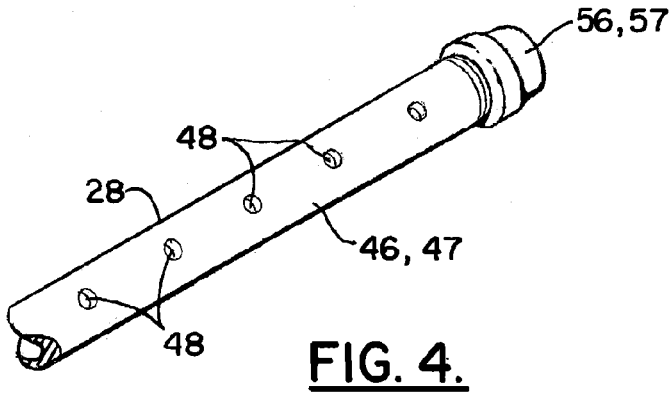
FIG. 4 is a fragmentary perspective view of an alternative embodiment of the apparatus of the present invention.

A plurality of posts 14 (which can each be about 3-6 inches wide by about 3-6 inches deep by 24-60 inches high) extend upwardly from the combination of beams 12, 13 as shown in FIG. 3. Each post 14 supports a clamp 15 (made of, for example, steel, aluminum, or brass). Each clamp 15 has a lower section 16 and an upper section 17. These sections can be generally u-shaped or semi-circular so that when they are combined together they conform to and cradle a pipeline pig 30 as shown in FIG. 6. Pipeline pig 30 can be about 12-96 inches long and about 6-48 inches in diameter. The upper and lower sections of the clamp 15 can be connected using a hinge 18. A cable 19 (made of, for example, copper, brass, or steel) can be attached to upper section 17. The cable 19 can be a chain, cable or the like. The cable 19 functions as a tether to hold swivel 20, nut 21 and ring 22. The nut 21 forms a connection with bolt 23. Ring 22 can be used to secure swivel 20 to nut 21.

Each of the clamp sections 16, 17 provides a flange. The lower section 16 provides flange 24. The upper section 17 provides flange 25. These flanges abut when the clamp 15 is closed. Each flange 24, 25 provides an opening that enables bolt 23 to extend through the openings of the flanges 24, 25 when a bolted connection is to be formed between bolt 23 and nut 21. Instead of bolts, one could use a ring clip, a clamp, or a cotter pin as fasteners.

Frame 11 is preferably a liftable frame. A plurality of padeyes 26 are provided, each preferably equipped with a shackle 27 as shown in FIG. 3. Rigging such as slings 32 can be attached to frame 11 using padeyes 26 and shackles 27.

FIG. 5 illustrates frame 11 being lowered into vessel 49. The vessel 49 is an inner tank 49. An outer tank 50 is also provided as shown in FIG. 6. This dual tank arrangement enables spillage to be controlled so that no pollutants escape apparatus 10. In FIG. 5, rigging 32, 33, 34, 35 is provided for lifting the combination of frame 11 and pipeline pig 30.

Manifold 28 (made of, for example, galvanized pipe, polymeric pipe, such as polypropylene pipe, or copper pipe and about 0.5-6 inches wide and about 3-21 feet long) is attached to and supported by frame 11 as shown in FIG. 5. Arrow 29 in FIG. 5 illustrates a lowering of frame 11, manifold 28, and pig 30, into the inner tank 49. The rigging that supports the frame 11 during the lowering of FIG. 5 can include a plurality of slings 32, lifting eye 33, and crane hook 34. Crane hook 34 is supported with a crane line 35 that can be attached to any known commercially available lifting device, crane or the like.

Figure 1:
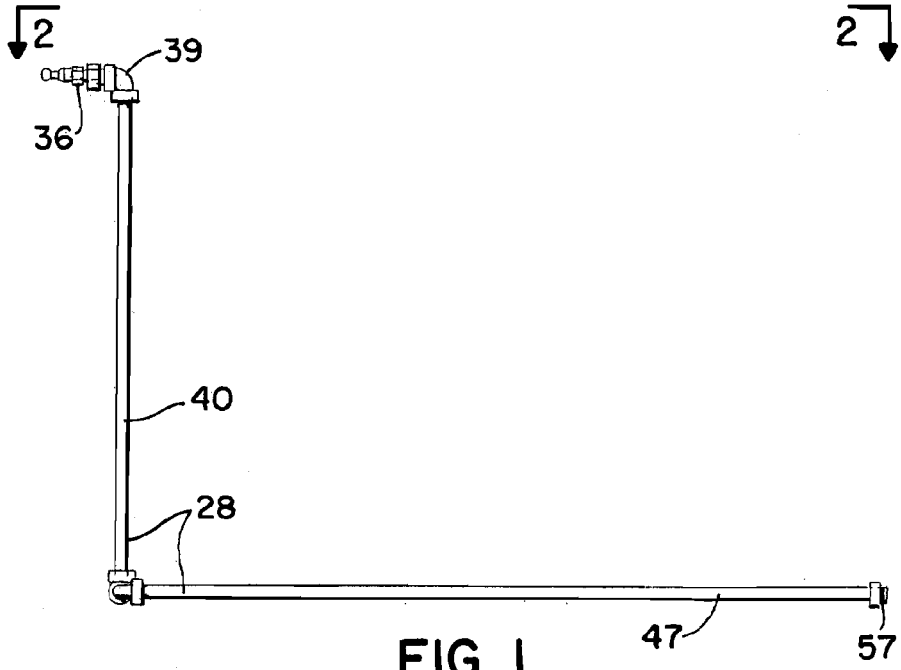
FIG. 1 is a fragmentary, elevation view of the preferred embodiment of the apparatus of the present invention.

The pipeline pig 30 has a smaller diameter cylindrical section 31 that is gripped by a pair of the clamps 15 of frame 11 as shown in FIG. 5. Manifold 28 is shown more clearly in FIGS. 1 and 2 wherein it has been removed from frame 11 for purposes of clarity. Manifold 28 provides an inlet fitting 36 (preferably made of brass, stainless steel, or carbon steel) that communicates with an influent flow line such as a hose 37. Influent flow line 37 connects to inlet fitting 36 through connection 38. Connection 38 can be a union or any other known connection such as a quick release connection or coupling.

Figure 2:
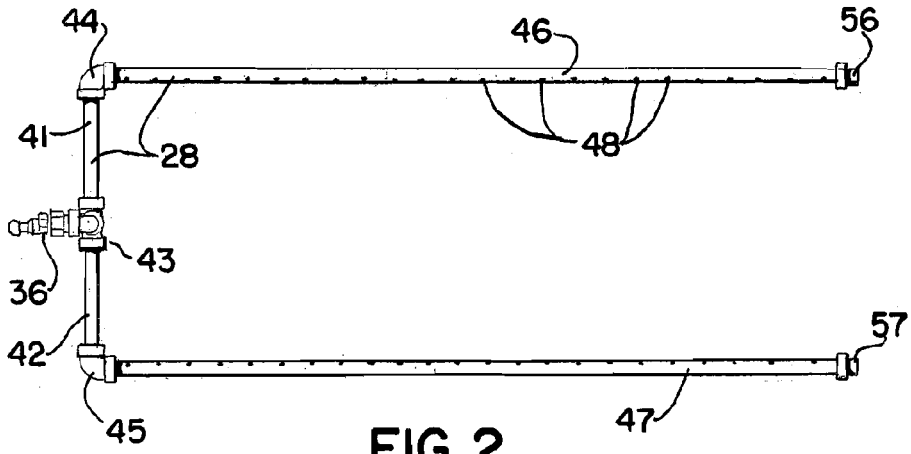
FIG. 2 is a sectional view taken along lines 2-2 of FIG. 1.

Inlet fitting 36 communicates with elbow fitting 39. Elbow fitting 39 is joined to non-perforated pipe section 40. The non-perforated pipe section 40 is a generally vertically extended section that attaches to tee fitting 43. Tee fitting 43 connects to a pair of non-perforated pipe sections 41, 42 as shown in FIG. 2. A pair of perforated pipe sections 46, 47 are provided. These pipe sections 46, 47 are generally parallel and extend longitudinally generally parallel to longitudinal beam 12 of frame 11 as shown in FIG. 5. The perforated pipe section 46 is joined to non-perforated pipe section 41 using elbow fitting 44. Similarly, perforated pipe section 47 is joined to non-perforated pipe section 42 using elbow fitting 45. Each of the perforated pipe sections 46, 47 is provided with a plurality of perforations 48 that extend along the length of each of the pipe sections 46, 47 as shown in FIG. 2. Preferably, the perforations are about 1-4" apart and about 1/32-1" in diameter. Preferably, there are at least 50-150 perforations.

Each of the perforated pipe sections 46, 47 provides a closed end 56, 57 respectively. Such a closed end can be in the form of a blind cap fitting (preferably made of copper, brass, or stainless steel). Each of the inner and outer tanks 49, 50 is provided with valving and outlet fittings (preferably made of steel, aluminum, or polymeric material, such as polypropylene). Tank 49 provides an outlet 51 and valve 52. The same or a similar type of outlet 51 and valve 52 outflow arrangement can be provided for tank 50 as shown in FIG. 6. Either or both of the outlet 51 and valve 52 arrangements on tanks 49, 50 can be provided with a flow line or hose 53.

In FIG. 6, airflow (i.e. bubbles) is indicated generally by the numerals 54. During use, the pipeline pig 30 is lowered into inner tank 49 which is filled to level 58 or to a level almost equal to level 58 with a solvent solution 59 for removing residual matter from pig 30. This residual matter can be for example, paraffin and/or asphaltene and/or basic solids.

The solvent 59 is preferably a solvent which can dissolve the paraffins or asphaltenes, or other such residual matter (such as Sludge Breaker I commercially available from Chemex, Inc. of Lafayette, La.—see also the solvents mentioned in U.S. Patent Application Publication No. 2006/0011341). PLEASE CONFIRM SOLVENT INFO. Sludge Breaker I is a terpene blend with an ethoxylated alcohol. When the pipeline pig 30 is placed in vessel 49 and subjected to the cleaning action of the solvent 59 contained therein air emitted via perforated pipe sections 46, 47 and the perforations 48 provides a mechanical action that enhances removal of any residual material contained on pipeline pig 30.

As part of the method of the present invention, a number (for example, 1-100) of pipeline pigs 30 are sequentially placed inside vessel 49 and under level 58. Solvent 59 contained in vessel 49 in combination with the scrubbing action of air bubbles 54 emitted from perforations 48 removes the residual matter (paraffin, for example) therefrom.

After a number of pigs 30 have been placed into vessel 49 and subjected to the cleaning action of solvent 59 and in combination with air bubbles 54, the residual matter contained on the pig 30 accumulates within the solvent 59. After, for example, between about 80 and 100 pigs 30 have been cleaned in this manner, the solvent 59 becomes a combination of paraffins and/or asphaltenes and terpene which can be mixed with used oil and sold as bunker fuel. Thus the present invention provides an improved business method of recycling paraffins and/or asphaltenes.

Cleaning of the pigs could be done at ambient temperature, such as at room temperature, though the solvent could be heated.

The solvent evaporates at room temperature, so one can cover the vats with a lid (not shown in the drawings) to keep the volatiles in the vat. The lid could be made of aluminum, fiberglass, or steel, for example, and attached to vat 49 with clamps, for example.

The air can be recaptured and recycled within the container with the lid on it to reduce fumes or prevent them from escaping. Also one could recirculate the solvent itself through the tubes via the ports 48 with a pump as an alternative way but using air to circulate through the liquid is more cost effective.

The following is a list of parts and materials suitable for use in the present invention.

PARTS LIST

| Part Number | Description and Exemplary Materials |
|---|---|
| 10 | pipeline pig cleaning apparatus |
| 11 | frame (steel, aluminum, or brass) |
| 12 | longitudinal beam |
| 13 | transverse beam |
| 14 | post |
| 15 | clamp (stainless steel or aluminum) |
| 16 | lower section |
| 17 | upper section |
| 18 | hinge |
| 19 | cable (stainless steel or galvanized steel) |
| 20 | swivel |
| 21 | nut |
| 22 | ring |
| 23 | bolt |
| 24 | flange |
| 25 | flange |
| 26 | padeye (stainless steel or galvanized steel) |
| 27 | shackle |
| 28 | manifold (copper or brass) |
| 29 | arrow |
| 30 | pipeline pig |
| 31 | smaller diameter cylindrical section |
| 32 | rigging or sling (chain, rope, or cable) |
| 33 | lifting eye |
| 34 | crane hook |
| 35 | crane line |
| 36 | inlet fitting |
| 37 | hose/influent flow line |
| 38 | connection (rubber, steel, or brass) |
| 39 | elbow fitting |
| 40 | non-perforated pipe section |

-continued

| PARTS LIST | |
|---|---|
| Part Number | Description and Exemplary Materials |
| | (polypropylene, metal, brass) |
| 41 | non-perforated pipe section (polypropylene, metal, brass) |
| 42 | non-perforated pipe section (polypropylene, metal, brass) |
| 43 | tee fitting |
| 44 | elbow fitting |
| 45 | elbow fitting |
| 46 | perforated pipe section (polypropylene, metal, brass) |
| 47 | perforated pipe section (polypropylene, metal, brass) |
| 48 | perforation |
| 49 | vessel, inner tank (painted steel, stainless steel, or aluminum) |
| 50 | outer tank (painted steel, stainless steel, or aluminum) |
| 51 | outlet |
| 52 | valve |
| 53 | flow line |
| 54 | air flow or bubbles |
| 56 | closed end |
| 57 | closed end |
| 58 | levee |
| 59 | solvent solution |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of removing material from a pipeline pig and recycling the material, comprising the steps of:

a) providing a vessel having an interior;

b) placing a manifold within the vessel interior, the manifold having one or more openings;

c) filling the vessel with a solvent;

d) placing a pipeline pig to be cleaned within the vessel and above the manifold;

e) immersing the pipeline pig in the solvent in steps "c" and "d";

f) bubbling a gas into the vessel via the manifold openings;

g) cleaning said pipeline pig by repeating steps "d" through "f" with multiple pipeline pigs in sequence so that material is removed from each of said pipeline pigs and said material is concentrated over time within the vessel; and h) recycling the material removed from said pipeline pigs.

2. The method of claim 1 wherein the solvent is a terpene blend with an ethoxylated alcohol.

3. The method of claim 1 wherein the manifold is perforated along a portion of its length with spaced apart perforations.

4. The method of claim 1 wherein the manifold includes multiple sections of pipe and comprising the steps of placing a pipe section on opposing sides of the pipeline pig to be cleaned.

5. The method of claim 1 wherein the material removed from said pipeline pigs includes paraffin.

6. The method of claim 1 further comprising the step of heating the solvent to an elevated temperature.

7. A method of removing paraffin material from a pipeline pig and recycling the paraffin material, comprising the steps of:

a) providing a vessel having an interior;

b) placing a manifold within the vessel interior, the manifold having one or more openings;

c) filling the vessel with a solvent;

d) placing a pipeline pig to be cleaned within the vessel and above the manifold;

e) immersing the pipeline pig in the solvent in steps "c" and "d";

f) bubbling a gas into the vessel via the manifold openings;

g) cleaning said pipeline pig by repeating steps "d" through "f" with multiple pipeline pigs in sequence so that paraffin material is removed from each of said pipeline pigs and said paraffin material is concentrated over time within the vessel; and h) recycling the paraffin material removed from said pipeline pigs.

8. The method of claim 7 wherein the solvent is a terpene blend with an ethoxylated alcohol.

9. The method of claim 7 wherein the manifold is perforated along a portion of its length with spaced apart perforations.

10. The method of claim 7 wherein the manifold includes multiple sections of pipe and comprising the steps of placing a pipe section on opposing sides of the pipeline pig to be cleaned.

11. The method of claim 7 further comprising the step of heating the solvent to an elevated temperature.

12. A method of removing paraffin material from a pipeline pig and recycling the paraffin material, comprising the steps of:

a) providing a vessel having an interior;

b) placing a manifold within the vessel interior, the manifold having one or more openings;

c) filling the vessel with a solvent;

d) placing a pipeline pig to be cleaned within the vessel and above the manifold;

e) immersing the pipeline pig in the solvent in steps "c" and "d";

f) bubbling a gas into the vessel via the manifold openings, wherein the bubbles flow next to an entire outer surface of the pipeline pig;

g) cleaning said pipeline pig by repeating steps "d" through "f" with multiple pipeline pigs in sequence so that paraffin material is removed from each of said pipeline pigs and said paraffin material is concentrated over time within the vessel; and h) recycling the paraffin material removed from said pipeline pigs.

* * * * *